United States Patent [19]

Kochar

[11] Patent Number: 5,047,121

[45] Date of Patent: Sep. 10, 1991

[54] HIGH GRADE POLYETHYLENE PAPER

[75] Inventor: Gurvinder P. S. Kochar, Midlothian, Va.

[73] Assignee: E. I. Du Pont de Nemours and Company, Wilmington, Del.

[21] Appl. No.: 585,448

[22] Filed: Sep. 20, 1990

[51] Int. Cl.[5] ..... D21H 13/14

[52] U.S. Cl. ..... 162/146; 162/157.5; 162/206

[58] Field of Search ..... 162/146; 157.2, 157.5, 162/206

[56] References Cited

U.S. PATENT DOCUMENTS

| | | | |
|---|---|---|---|
| 2,999,788 | 9/1961 | Morgan | 162/146 |
| 3,169,899 | 2/1965 | Steuber | 161/72 |
| 3,808,091 | 4/1974 | Aoki et al. | 162/157 R |
| 3,878,183 | 4/1975 | Koga et al. | 260/94.9 R |
| 3,891,499 | 6/1975 | Kato et al. | 162/157 R |
| 3,902,957 | 9/1975 | Kozlowski | 162/157 R |
| 3,920,507 | 11/1975 | Yonemori | 162/157 |
| 3,920,508 | 11/1975 | Yonemori | 162/157 |
| 3,920,509 | 11/1975 | Yonemori | 162/157 |
| 3,957,573 | 5/1976 | Miyamoto et al. | 162/102 |
| 4,107,243 | 8/1978 | Stearns et al. | 264/13 |
| 4,110,385 | 8/1978 | Sander et al. | 162/157.5 |
| 4,310,591 | 1/1982 | Lee et al. | 428/283 |
| 4,404,314 | 9/1983 | Jabloner | 524/519 |
| 4,554,207 | 11/1985 | Lee | 428/288 |
| 4,608,089 | 8/1986 | Gale et al. | 106/90 |
| 4,647,497 | 3/1987 | Weeks | 428/284 |
| 4,783,507 | 11/1988 | Tokunaga et al. | 525/240 |

FOREIGN PATENT DOCUMENTS

| | | |
|---|---|---|
| 0292285 | 11/1988 | European Pat. Off. . |
| 2378728 | 8/1978 | France . |
| 891945 | 3/1962 | United Kingdom . |
| 895081 | 5/1962 | United Kingdom . |

OTHER PUBLICATIONS

Chemical Abstracts, 65338x, vol. 105, No. 8, p. 303 (8/86) discussing Jap. Patent Application 60 141659-A (Mitsui Petrochem. Ind.).

W. A. Kindler: "The Influence of Synthetic Pulp Fibers on Web Behavior", TAPPI, vol. 59, No. 5, pp. 113-116 (May 1976).

Kirk-Othmer: Encyclopedia of Chemical Technology, vol. 19, 3rd edition, John Wiley & Sons, pp. 420-435 (1982).

*Primary Examiner*—Peter Chin

[57] ABSTRACT

A process is disclosed for producing high grade synthetic paper containing at least 97 wt. % polyethylene on conventional continuous wet-lay paper-making equipment. In particular, the process comprises preparing a pulp furnish of 97-99.5 wt. % oriented polyethylene fibers and 0.5-3.0 wt. % polyvinyl alcohol fibers and depositing the fibers on the forming screen of a conventional wet-lay paper machine. The resulting waterleaf sheet is then dried on heated PTFE-coated drying cans, using a particular drying profile to reduce sticking and elongation, and then thermally bonded to provide a polyethylene paper having high strength, low defects and excellent uniformity. A process for producing the pulp fibers used in the paper-making process is also disclosed.

11 Claims, 1 Drawing Sheet

HIGH GRADE POLYETHYLENE PAPER

FIELD OF THE INVENTION

The present invention relates to a process for producing high grade synthetic paper. In particular, the invention relates to a process for producing high quality polyethylene pulp and converting the pulp into high strength, low defect polyethylene paper on conventional continuous wet-lay paper-making equipment.

BACKGROUND OF THE INVENTION

Spunbonded fibrous sheets made of multiple plexifilamentary strands of oriented polyethylene film fibrils are disclosed in U.S. Pat. No. 3,169,899 (Steuber). Such sheets are produced commercially by E. I. du Pont de Nemours and Company under the trademark "Tyvek®" spunbonded olefin. The sheets have proven useful in diverse applications which take advantage of the sheets' unusually good combination of strength, tear resistance and permeability properties.

Polyethylene pulps can be prepared by cutting these Tyvek® sheets into small pieces and beating the cut pieces in an aqueous refiner. Examples of other methods for producing polyolefin pulps are given in Kirk-Othmer: *Encyclopedia of Chemical Technology,* Vol. 19, 3rd edition, John Wiley & Sons, pp. 420–435 (1982). This reference describes synthetic pulps as generally being very fine, highly branched, discontinuous, water-dispersible fibers made of plastics. Methods are described for producing synthetic pulps by solution flash-spinning, emulsion flash-spinning, melt-extrusion/fibrillation and shear precipitation. The pulps may be blended with other fibers in an attempt to make papers, sheets or boards by conventional wet-lay papermaking techniques. Such pulps are also identified as being used as bonding agents for certain nonwoven materials such as dry-laid, Rando-Webber formed sheets and wet-laid, Fourdrinier-formed sheets.

U.S. Pat. No. 4,608,089 (Gale et al.) discloses forming oriented polyethylene film-fibril pulps by cutting a flash-spun polyethylene sheet (e.g., Tyvek®) into pieces, forming an aqueous slurry with the pieces and then refining the pieces with disc refiners to form a pulp that is particularly suited for cement reinforcement. The pulp is prepared from flash-spun plexifilaments which are cut into small pieces and beaten in an aqueous medium. Although these pulps have found some utility in reinforcing cement composites, they are not useful in making high grade polyethylene paper.

European Patent Application No. 292,285 (Gale et al.) discloses forming improved oriented polyethylene film-fibril pulps for reinforcing various articles. The pulps are prepared from flash-spun, oriented, linear polyethylene, plexifilamentary strands that are converted into small fibrous pieces that are then reduced in size by refining in an aqueous medium to form a fibrous pulp slurry. The pulp slurry is then further refined until an average fibrid length of no greater than 1.2 mm is achieved and no more than 25% of the fibrous pulp is retained on a 14-mesh screen and at least 50% of the pulp passes through the 14-mesh screen but is retained by a 100-mesh screen. Various articles are disclosed which can be made from the improved pulp. These include, speciality synthetic papers, reinforced gaskets, reinforced cements, reinforced resinous articles and heat-bonded sheets which are particularly useful for filtration applications. Although these pulps have found some utility in reinforcing applications and in producing paper hand sheets, they are not satisfactory for making high grade, low basis weight polyethylene paper on conventional continuous wet-lay paper-making equipment.

One of the problems encountered when trying to make high grade paper on conventional continuous paper-making equipment with these types of polyethylene fibers is that they tend to stick to the drying cans while the sheet is being dried. Moreover, during the drying process the sheet will stretch in the machine direction and lose tension in between the drying cans. This causes the paper sheet to have poor uniformity.

Although there are some methods available which allow synthetic paper to be made from polyethylene pulp on conventional paper-making eqipment, they require unique fibers and process steps. One such example is disclosed in U.S. Pat. No. 4,783,507, where the inventive feature rests in the use of two polyethylene pulps, one that melts at 95° C. or below and one that melts at higher temperatures. Paper can be prepared from the two polyethylene pulps on a conventional paper-making machine using drying cans which are heated by 212° F. steam. The polyethylene pulps used to make the paper are prepared by the process of U.S. Pat. No. 3,920,508 (Yonemori). Yonemori discloses flash-spinning an emulsion of polyethylene and refining the resulting fibers.

Clearly, what is needed is a process for producing high grade polyethylene paper from pulp on conventional continuous wet-lay paper-making equipment. The paper should have reduced elongation, high strength and a low number of defects (i.e., increased uniformity). Other objects and advantages of the present invention will become apparent to those skilled in the art upon reference to the drawings and the detailed description of the invention which hereinafter follows.

SUMMARY OF THE INVENTION

The present invention is directed to a process for preparing a high grade synthetic paper, containing at least 97 wt. % polyethylene, on conventional continuous wet-lay paper-making equipment. The process comprises the steps of:

(a) preparing a pulp furnish comprising:
  (i) 97–99.5 wt. % polyethylene fibers having an average length of between 0.7 to 1.0 mm, a defect level of between 0 to 6%, and a coarseness of between 0.150 to 0.222 mg/m; and
  (ii) 0.5–3.0 wt. % polyvinyl alcohol binder fibers;

(b) depositing the pulp furnish on the screen of a wet-lay paper-making machine to form a waterleaf sheet;

(c) drying the resulting waterleaf sheet on heated drying cans wherein the drying cans have a drying profile such that an initial drying phase is provided at a temperature of between 200° to 270° F. to melt the polyvinyl alcohol fibers and a second drying phase is provided at a temperature between 190° to 240° F. to control stretch and elongation of the sheets; and (d) thermally bonding the dried sheet at a temperature between 250°–315° F. to provide a high grade paper having a Frazier porosity of at least 4 ft3/ft2/min.

The critical steps of the paper-making process include mixing a small amount of polyvinyl alcohol binder fibers with the polyethylene fibers, providing a particular drying profile to regulate drying temperatures, and bonding the dried fibers. The polyvinyl alcohol fibers melt during the initial drying phase and add strength to the resulting paper sheet upon bonding. In fact, the strength of the paper sheet can be tailored by the amount of polyvinyl alcohol fibers mixed into the polyethylene fibers. The specific drying profile reduces sticking and controls sheet elongation. In a preferred embodiment, the drying cans are sprayed with a release coating, such as polytetrafluoroethylene (PTFE), to further reduce sticking. The result of the process is a high grade polyethylene paper which has high wet and dry strength, reduced elongation and excellent uniformity (i.e., high porosity and low defects). The resulting paper generally has a basis weight of between 1.5 to 4.5 oz./yd$^2$. The paper is particularly useful in filtration applications (e.g., vacuum cleaner bags) and in making battery separators.

The process for preparing the polyethylene pulp used in the above-described paper-making process involves some of the same steps as used in preparing the fibrous pulps of Gale et al. in European Patent Application No. 292,285. The common steps include flash-spinning a linear polyethylene polymer into strands of oriented film fibrils having a birefringence of at least 0.030 and converting the strands into small pieces that are then reduced in size by refining in an aqueous medium to form a fibrous pulp slurry. However, in order to produce polyethylene pulp of the quality necessary to make high grade polyethylene paper, the following improvement must be made to the process of Gale et al. The improvement comprises performing the following additional steps:

(1) mixing the refined aqueous slurry with polyvinyl alcohol;

(2) passing the mixture through a first single disc refiner having a plate gap setting of between 0.01 to 0.04 inches;

(3) passing the mixture from the first single disc refiner through a second single disc refiner fitted with peripheral rings having a gap setting of 0.002 to 0.016 inches and a plate gap setting of 0.007 to 0.021 inches;

(4) filtering the refined mixture through a screen having a hole size of 0.040 to 0.098 inches; and (5) dewatering the filtered pulp. The second disc refiner is equipped with a set of peripheral rings which are set within a critical range of gap settings to control the defect level and fiber length of the pulp. The gap setting of the rings in relation to the main refiner plates is what defines the critical setting. This setting must be maintained in order to produce pulps having acceptable properties for producing high grade polyethylene paper. Preferably, the plate gap setting is set between 3 to 5 mils above the ring gap setting. Fibrous pulps produced by the above-described process exhibit high strength, fineness and a low number of defects.

DETAILED DESCRIPTION OF THE PREFERRED EMBODIMENTS

Figure 1:
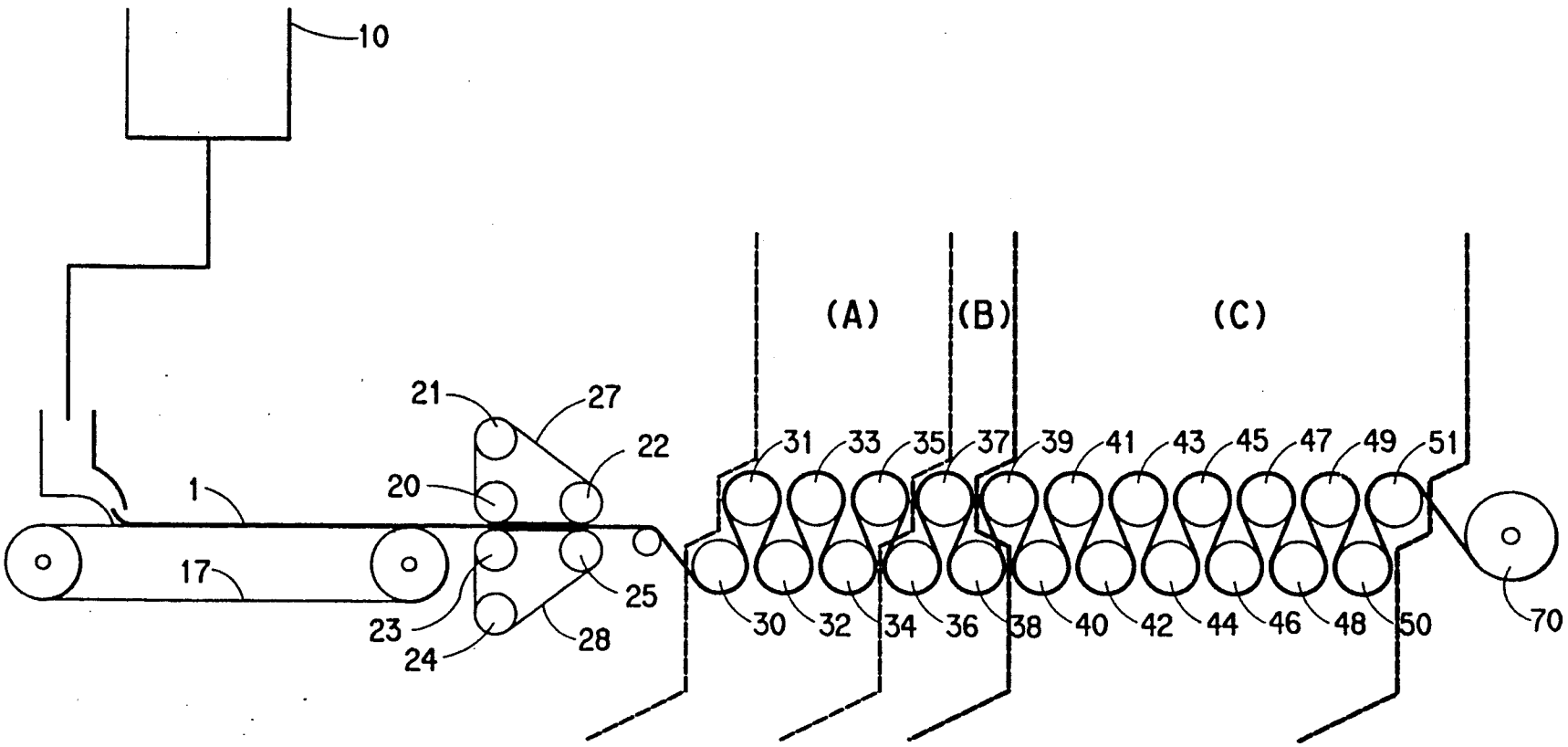
FIG. 1 shows a schematic view of a conventional wet-lay Fourdrinier paper-making machine wherein a wet-laid layer of fibrous pulp 1 is advanced on a forming screen 17 to a press section (rolls 20–25 and belts 27 and 28), an initial drying section (cans 30–35), a secondary drying section (cans 36–38), and a thermal bonding section (rolls 39–51) and then to a windup to form roll 70 of high grade polyethylene paper.

The present invention is directed to providing a process for producing high grade polyethylene paper from polyethylene pulp that has been specially processed. The pulps of the present invention represent an improvement over the oriented polyethylene fibrid pulps known in the art. For example, the pulps of U.S. Pat. No. 4,608,089 (Gale et al.) and European Patent Application No. 292,285 (Gale et al.), while good for certain reinforcing applications, are not satisfactory for producing high grade, low basis weight polyethylene paper on conventional continuous paper-making equipment. The difference between the pulps of the invention and those of Gale et al. in the EPO application can be readily seen from the comparisons given below in the Examples. In order to produce a high grade polyethylene paper of relatively low basis weight, the pulps used must be of unique character. Specifically, the pulps of the invention, as compared to both Gale et al. references, must have a low size and number of defects (chips and pills) and a high level of wet and dry fiber strength.

In accordance with the present invention, the preferred process for making oriented polyethylene pulps necessary for producing high grade polyethylene paper includes certain steps known in the art. For example, U.S. Pat. No. 4,608,089 (Gale et al.) discloses forming a fibrous pulp of oriented polyethylene fibrids having a birefrigence of at least 0.030 by the steps of (a) flash-spinning linear polyethylene into interconnected strands of oriented polyethylene film-fibrils, (b) converting the strands into small pieces and (c) reducing the size of the pieces in an aqueous slurry pulp refiner. In the process of the present invention, the pulps are further processed in order to reduce improved polyethylene pulp of a quality suitable for making high grade polyethylene paper. The improvement comprises performing the following additional steps:

(d) mixing the refined aqueous slurry with polyvinyl alcohol;

(e) passing the mixture through a first single disc refiner having a plate gap setting of between 0.01 and 0.04 inches;

(f) passing the mixture from the first single disc refiner through a second single disc refiner fitted with peripheral rings having a gap setting of 0.002 to 0.016 inches and a plate gap setting of 0.007 to 0.021 inches;

(g) filtering the refined mixture through a screen having a hole size of 0.040 to 0.098 inches; and (h) dewatering the filtered pulp.

The second disc refiner is equipped with a set of peripheral rings which are set within a critical range of gap settings to control the defect level and fiber length of the pulp. The gap setting of the rings in relation to the main refiner plates is what defines the critical setting. Preferably, the plate gap setting is between 0.015 to 0.018 inches and the ring gap setting is between 0.010 to 0.015. Particularly preferred settings include a plate gap setting of 0.018 inches and a ring gap setting of 0.015 inches. Equipment suitable for performing the additional steps is described in more detail in the Examples below.

The resultant fibrids are characterized by an average length of between 0.7 and 1.0 mm, an opacity of between 75 and 90%, a coarseness of between 0.150 and 0.222 mg/m, and a defect level of between 0 and 6%. The fibrids also range in size such that no more than 25%, preferably no more than 10%, of the pulp fibrids are retained on a 14 mesh screen, all screen sizes being in accordance with Bauer-McNett Classification Screen sizes.

The various characteristics referred to herein for the pulps and paper made from them are measured by the following methods. In the description of the methods, ASTM refers to the American Society of Testing Materials, TAPPI refers to the Technical Association of the Pulp and Paper Industry and ISO refers to the International Organization for Standardization.

Fiber length and coarseness are determined by the Kajaani test method commonly used in the paper industry. Average fiber length is measured by a Kajaani FS-100 apparatus having an orifice diameter of 0.4 mm. The apparatus is used to sample a pulp fiber population and provide a weighted distribution. The total number of fibers are counted and an average fiber length is calculated from the weighted fiber distribution.

Percent defects are determined by the Pulmac test method also commonly used in the paper industry. A Pulmac shive analyzer having a slit width of 4 mils is used to measure the percentage of defects in the pulp. Defects are most commonly seen as pills and chips.

Birefringence is measured by the technique provided in detail in U.S. Pat. No. 4,608,089 (Gale et al.), column 2, line 64 through column 3, line 33, which specific disclosure is incorporated herein by reference.

Bauer-McNett values are measured in accordance with TAPPI T33 OS75.

Opacity of a dried water-laid paper is measured with a Technidyne Micro TBIC testing instrument (manufactured by Technidyne Corporation of New Albany, Ind.) which conforms with ISO Standards 2469 and 2471 and TAPPI T519 for measurements of diffuse opacity. The determinations are made in accordance with procedures published by Technidyne, "Measurement and Control of the Optical Properties of Paper" (1983) and in particular employ diffuse geometry with a Position B filter which has a 457 nm effective wavelength. The determinations are analyzed statistically to provide the average opacity and its variance for sheets of a given pulp. A small variance of opacity indicates the ability of a pulp to form uniform, non-blotchy synthetic pulp sheet.

Frazier porosity is measured in accordance with ASTM D 737-46 and is reported in cubic feet per square feet per minute.

Drainage (commonly known as Canadian Standard Freeness [CSF]) is measured in accordance with TAPPI T-227 test method and is reported in milliliters (ml).

The number of pills is measured in accordance with a visual test. Pills which are 0.5 mm or greater in height on a 8"×8" hand sheet of 2.0 oz/yd$^2$ basis weight are visually counted and recorded.

Once the improved polyethylene pulps have been produced, they can be converted into high grade synthetic paper by the inventive paper-making process. The paper is made on conventional continuous wet-lay paper-making equipment by first preparing a pulp furnish comprising 97–99.5 wt. % polyethylene fibers and 0.5–3.0 wt. % polyvinyl alcohol binder fibers. The furnish fibers have an average length of between 0.7 to 1.0 mm, a defect level of between 0 to 6%, and a coarseness of between 0.150 to 0.222 mg/m. Suitable polyvinyl alcohol fibers are commercially available through Kuraray Co., Ltd. of Osaka, Japan under the tradename "Kuralon". In preparing the furnish, the polyethylene pulp fibers are uniformly dispersed in water to about a 2 wt. % solids consistency. Polyvinyl alcohol fibers are added at 1 wt. % as a binder fiber. The furnish is further diluted with water to about a 0.5 wt. % solids consistency.

The furnish is then deposited on the forming screen of a conventional wet-lay paper-making machine (e.g., Fourdrinier machine). The furnish is dewatered to form a waterleaf sheet. Thereafter, the resulting waterleaf sheet is dried across a series of heated drying cans. The drying cans provide a unique drying profile such that an initial drying phase is provided at a temperature of between 200° to 270° F. to melt some of the polyvinyl alcohol fibers and a second drying phase is provided at a temperature between 190° to 240° F. to control stretch and elongation of the fibers. Preferably, the drying cans are sprayed with a release coating, such as polytetrafluoroethylene (PTFE), in order to further reduce the chance of fibers sticking to the can surface.

Lastly, the dried sheet is thermally bonded at a temperature between 250°–315° F. to provide a high grade polyethylene paper having a Frazier porosity of at least 4 ft3/ft2/min. The porosity of the paper may be tailored to a specific application by passing the sheet through a series of heated cans (i.e. a roll bonder) and modifying the bonding temperature. During bonding, the sheet is typically held in place by electrostatic and/or pressure means to minimize sheet shrinkage. It has been determined that the porosity of paper produced by the inventive process is directly proportional to temperature (i.e., the sheet becomes more porous as temperature is increased, but only up to a certain critical temperature limit of about 330° F. where porosity starts to decrease). This characteristic is the opposite of most prior art pulps where porosity is inversely proportional to temperature. Following bonding, the paper is wound up in roll form for purposes of storage and or transportation.

The invention will be more readily understood by referring to the attached drawing, which is a schematic representation of equipment suitable for making paper according to the invention. FIG. 1 shows a typical Fourdrinier machine wherein a wet-laid layer of furnish fibers 1 is floated on a forming screen 17 from a pulp header box 10 and advanced through a press section (rolls 20–25 and belts 27–28) to dewater the fibers. The resulting waterleaf sheet is then passed through a dryer section (cans 30–38) having a unique drying profile. The cans are heated such that an initial heating phase (A) is provided at a temperature of between 200° to 270° F. to melt the polyvinyl alcohol fibers (cans 30–35) and a second heating phase (B) is provided at a temperature between 190° to 240° F. to control stretch and elongation of the fibers (cans 36–38).

The bonding of the sheet in the thermal bonding phase (C) can be accomplished with conventional equipment, such as a calender roller. Particularly preferred equipment for carrying out the bonding is disclosed by Lee in U.S. Pat. No. 4,554,207. For the bonding operation, all rolls are operated at substantially the same peripheral speeds. The bonding temperature is maintained between 250°–315° F. to provide a Frazier porosity of at least 4 ft3/min./ft2. As noted above, the temperature may be varied within this range to produce paper of a particular porosity depending on the specific end-use application.

In the non-limiting Examples which follow, all percentages and ratios of composition ingredients are by total weight of the composition, unless indicated otherwise.

EXAMPLE 1

Oriented polyethylene pulps and papers made by the processes of the invention are compared in these examples with similar pulps and papers of Gale et al., European Patent Application No. 292,285.

The starting material for the preparation of each polyethylene pulp was substantially as described in European Patent Application 292,285 (Gale et al.). In brief, a solution of linear polyethylene in trichlorofluoromethane was flash spun into plexifilamentary strands of oriented film fibrils; the strands were formed into a sheet; the sheet was lightly consolidated and cut into small pieces in preparation for refining as a low concentration aqueous slurry.

For the prior art pulp, a starting sheet was slit into wide strips which were chopped into small pieces. The pieces were mixed with water to form a slurry of 2 wt. % solids content. The slurry was then treated in 3 passes through Model 36-2 Disc Refiners (commercially available through Sprout Waldron Company of Muncey, Pa.) which were operated at 1800 rotations/min. The refiners were equipped with Model 16808 A,B main plates and Model 17709 peripheral control rings. For the first pass, nominal clearance was 0.010 inch (0.254 mm) between the main plates and 0.003 inch (0.076 mm) between the eripheral control rings. For the last pass, the slurry was diluted to 1% solids. Feed rates to the first, second and third passes, based on dry weight of pulp, were respectively 3, 8, and 7 pounds per minute (1.4, 3.6, 3.2 kg/min.). The refined pulp was dewatered on a 150 mesh screen and then dried.

For the pulp of the invention, a starting sheet was slit into wide strips which were chopped into small pieces. The pieces were mixed with water to form a slurry of 2 wt. % solids content. The slurry was then treated in 1 pass through Model 36-1C Disc Refiner (commercially available through Sprout Waldron Company of Muncy, Pa.) which was operated at 1800 rotations/min. The refiner was equipped with Model 16808 A, B plate pattern. The nominal clearance was 0.030 inch (0.762 mm) and the feed rate, based on dry weight of pulp, was 8 pounds per minute (3.6 kg/min.). The refined pulp was then treated in 1 pass through Model 36-2 Disc Refiners which were operated at 1800 rotations/min. The refiners were equipped with Model 16808 A, B main plates and Model D4A134 peripheral control rings. The nominal clearance was 0.015 inch (0.381 mm) between the main plates and 0.010 inch (0.254 mm) between the peripheral control rings. Feed rate, based on dry weight of pulp, was 8, pounds per minute (3.6, kg/min.). The refined pulp was dewatered on a 150 mesh screen and then dried.

Pulps made from the process of Gale et. al., European Patent Application No. 292,285 and pulps made from the inventive process were compared and the results are provided in Table 1 below. The results indicate that the inventive pulps have higher sheet strength and a much lower percentage of defects (e.g. # of pills) at low basis weight such as 2 oz/yd$^2$.

TABLE 1

| Characteristic | Prior Art Pulp | Inventive Pulp |
|---|---|---|
| Fiber Length (mm) | 0.82 | 0.78 |
| 14 Mesh Screening* | 7.8 | 6.0 |
| Sheet Strength (lbs/in) (2 oz./yd$^2$) | 0.9 | 1.2 |
| Drainage (CSF)** | 530 | 450 |
| Opacity (%) | 84 | 80 |
| % Defects | 6.8 | 2.6 |
| Coarseness (mg/m) | 0.119 | 0.170 |
| # of Pills | 10 | 2 |

*Defined as percentage of pulp that is retained on a 14 mess screen.
**Canadian Standard Freeness (ml)

EXAMPLE 2

Bonded paper made from the prior art pulps of Gale et. al., European Patent Application No. 292,285, and pulps of the invention were compared in vacuum cleaner bag applications and the results are shown in Table 2 below.

TABLE 2

| Characteristic | Prior Art Paper | Inventive Paper |
|---|---|---|
| Basis Weight (oz/yd$^2$) | 1.98 | 1.95 |
| Thickness (mil) | 10.1 | 10.5 |
| Permeability (cfm/ft$^2$) | 6.4 | 8.5 |
| Mullen Burst Strength (psi) | 31 | 40 |
| Tensile Strength MD (lb/in) | 14.2 | 18 |
| Tensile Strength CD (lb/in) | 7.85 | 7 |
| Mean Pore Size (micron) | 9.1 | 8.7 |
| Min. Pore Size (micron) | 5.8 | 6.7 |
| Max. Pore Size (micron) | 9.4 | 22.5 |
| No. of Defects (Pills) | 9 | 2 |

Table 2 demonstrates that the prior art paper of Gale et al. differs substantially in permeability and number of defects from the paper produced by the inventive process when low basis weight paper (i.e. less than 2.0 oz/yd$^2$) is produced.

Although particular embodiments of the present invention have been described in the foregoing description, it will be understood by those skilled in the art that the invention is capable of numerous modifications, substitutions and rearrangements without departing from the spirit or essential attributes of the invention. Reference should be made to the appended claims, rather than to the foregoing specification, as indicating the scope of the invention.

What is claimed is:

1. A process for preparing a synthetic paper containing at least 97% polyethylene, on conventional continuous wet-lay, paper-making equipment, comprising the steps of:

(a) preparing a pulp furnish comprising:

(i) 97–99.5% polyethylene fibrids having an average length of between 0.7 to 1.0 mm, a defect level of between 0 to 6%, a birefrigence of at least 0.030 and a coarseness of between 0.15 to 0.222 mg/m; and (ii) 0.5–3.0% polyvinyl alcohol fibers;

(b) depositing the furnish on the screen of a paper-making machine to form a waterleaf sheet;

(c) drying the resulting waterleaf sheet on heated drying cans wherein the drying cans have a drying profile such that an initial drying phase is provided at a temperature of between 200° to 270° F. to melt the polyvinyl alcohol fibers and a second drying phase is provided at a temperature between 190° to 240° F. to control stretch and elongation of the fibers; and (d) thermally bonding the dried fibers at a temperature between 250°-315° F. to provide a Frazier porosity of at least 4 ft3/min./ft2.

2. The process according to claim 1 wherein the drying cans are coated with a release coating.

3. The process according to claim 1 wherein the release coating is polytetrafluoroethylene.

4. A process for preparing a synthetic paper containing at least 97% polyethylene, on conventional continuous wet-lay, paper-making equipment, comprising the steps of:

(a) preparing a pulp furnish comprising:

(i) 97.5-98.5% polyethylene fibrids having an average length of between 0.78 to 0.80 mm, a defect level of between 1 to 4%, a birefrigence of at least 0.030 and a coarseness of between 0.170 to 0.185 mg/m; and (ii) 1.5-2.5% polyvinyl alcohol fibers;

(b) depositing the furnish on the screen of a paper-making machine to form a waterleaf sheet;

(c) drying the resulting waterleaf on heated drying cans wherein the drying cans have a drying profile such that an initial drying phase is provided at a temperature of between 210° to 250° F. to melt the polyvinyl alcohol fibers and a second drying phase is provided at a temperature between 195° to 205° F. to control stretch and elongation of the fibers; and (d) thermally bonding the dried fibers at a temperature between 270°-305° F. to provide a Frazier porosity of at least 4 ft3/min./ft2.

5. A process according to claim 4 wherein the drying cans are coated with a release coating.

6. A process according to claim 5 wherein the release coating is polytetrafluoroethylene.

7. A wet-laid filter paper prepared by the process of claim 1.

8. A wet-laid, dried and thermally bonded paper sheet prepared by the process of claim 1.

9. An improved fibrous pulp of oriented polyethylene fibrids having a birefrigence of at least 0.030, the fibrids averaging between 0.7 to 1.0 mm in length, the improvement comprising the fibrids having a coarseness of between 0.150 to 0.222 mg/m and a defect level of between 0 to 6%.

10. A wet-laid filter paper prepared from the pulp of claim 9.

11. A wet-laid, dried and thermally bonded paper sheet prepared from the pulp of claim 9.

* * * * *